US005183023A

United States Patent [19]

Hanson

[11] Patent Number: 5,183,023

[45] Date of Patent: Feb. 2, 1993

[54] EVAPORATIVE EMISSION CONTROL SYSTEM FOR SUPERCHARGED INTERNAL COMBUSTION ENGINE

[75] Inventor: John D. Hanson, Bloomfield Hills, Mich.

[73] Assignee: Siemens Automotive Limited, Ontario, Canada

[21] Appl. No.: 786,487

[22] Filed: Nov. 1, 1991

[51] Int. Cl.[5] ..... F02M 33/02

[52] U.S. Cl. ..... 123/520; 123/519

[58] Field of Search ..... 123/519, 520, 521, 518, 123/516, 383

[56] References Cited

U.S. PATENT DOCUMENTS

| | | | |
|---|---|---|---|
| 4,527,532 | 7/1985 | Kasai | 123/520 |
| 4,700,683 | 10/1987 | Uranishi | 123/520 |
| 4,763,634 | 8/1988 | Morozumi | 123/520 |
| 4,862,856 | 9/1989 | Yokoe | 123/520 |
| 5,005,550 | 4/1991 | Bugin | 123/520 |

FOREIGN PATENT DOCUMENTS

| | | | |
|---|---|---|---|
| 0077545 | 6/1981 | Japan | 123/519 |
| 0000563 | 1/1984 | Japan | 123/520 |
| 0150961 | 8/1984 | Japan | 123/520 |

*Primary Examiner*—Carl S. Miller

*Attorney, Agent, or Firm*—George L. Boller; Russel C. Wells

[57] ABSTRACT

The canister's inlet port is communicated to the fuel tank headspace through a first conduit, its outlet port is communicated through a second conduit containing the purge control valve to a location in the air intake system that is downstream of the throttle plate, and its atmospheric vent port is communicated through a third conduit to a location in the air intake system that is between the air filter and the supercharger, rather than directly to atmosphere. During non-supercharged operation of the engine, vapors in the canister are purged through the second conduit and purge control valve in the usual manner and air enters the canister through the third conduit. During supercharged operation, the purge flow is reversed such that purged vapors pass through the third conduit while the purge valve maintains control over the purge flow.

2 Claims, 1 Drawing Sheet

EVAPORATIVE EMISSION CONTROL SYSTEM FOR SUPERCHARGED INTERNAL COMBUSTION ENGINE

FIELD OF THE INVENTION

This invention relates generally to evaporative emission control systems for automotive vehicles, and in particular to a system for a vehicle that is powered by a supercharged internal combustion engine.

BACKGROUND AND SUMMARY OF THE INVENTION

A known evaporative emission control system for a vehicle that is powered by a naturally aspirated internal combustion engine comprises a vapor collection canister having an inlet port in communication with the headspace of the fuel tank, an outlet port that is communicated through a canister purge valve with the induction air intake system at a location in the air intake system that is downstream of the throttle, and an atmospheric, or vent, port that is communicated to atmosphere. Volatile fuel vapors generated in the tank headspace are collected in the collection canister, and when the vehicle is operating under conditions that are conducive to canister purging, the collected vapors are conveyed by the purge control valve to the air intake system to entrain with the induction flow into the combustion chamber space of the engine. It is a typical practice to place the purge control valve under the control of an engine management computer which determines when and in what amount purging can occur. The purge flow is induced by the subatmospheric pressure that is created in the intake system so that in effect the collected vapors are sucked by the engine from the canister.

In the case of an engine which has some type of supercharging device, such as a blower or turbocharger, that is selectively operable to increase the power output of the engine over that which the engine is capable of producing when operating naturally aspirated, such an evaporative emission control system will be incapable of purging the canister during times of supercharged operation because the pressure in the intake system at the location therein to which the canister is communicated is now superatmospheric rather than subatmospheric. Thus a supercharged engine is confronted with the problem that such an associated evaporative emission control system will be incapable of purging the canister during periods of supercharged operation.

One known solution to this problem is to provide either a pneumatically operated switch valve which is operated by intake manifold pressure, or an electrically operated switch valve, to route the purge flow either upstream or downstream of the supercharger depending upon the activity of the supercharger.

The present invention relates to a new and unique solution to this problem which does not require the inclusion of a switched valve as in the foregoing solution. Indeed, the present invention can be implemented by the simple and relatively inexpensive expedient of providing a conduit from the atmospheric, or vent, port of the canister to a location in the air intake system that is upstream of the supercharger and throttle plate, preferably between the supercharger and an air filter that filters incoming airflow. During engine operation wherein the pressure in the air intake system below the throttle is subatmospheric, the purge system operates exactly the same as in the case of a strictly naturally aspirated engine. During engine operation wherein the pressure in the air intake system below the throttle is superatmospheric, the purge system operates to cause the purge flow to be conveyed out the atmospheric port, through the newly added conduit, to the intake system where the purge flow entrains with the filtered air flow entering the supercharger. During supercharged operation, the canister purge flow is induced by the combined effect of superatmospheric pressure downstream of the throttle acting on the canister purge outlet port through the canister purge valve and of subatmospheric pressure between the air filter and the supercharger acting on the canister atmospheric, or vent, port, and therefore, the purge control valve will also be effective to control the canister purge flow during supercharged engine operation. The term "supercharger" is used herein in a comprehensive sense to include any powered device that is capable of creating superatmospheric pressures in the intake system.

The foregoing features, advantages, and benefits of the invention, along with additional ones, will be seen in the ensuing description and claims which are accompanied by a drawing. The drawing discloses a presently preferred embodiment of the invention according to the best mode contemplated at the present time in carrying out the invention.

DESCRIPTION OF THE PREFERRED EMBODIMENT

Figure 1:
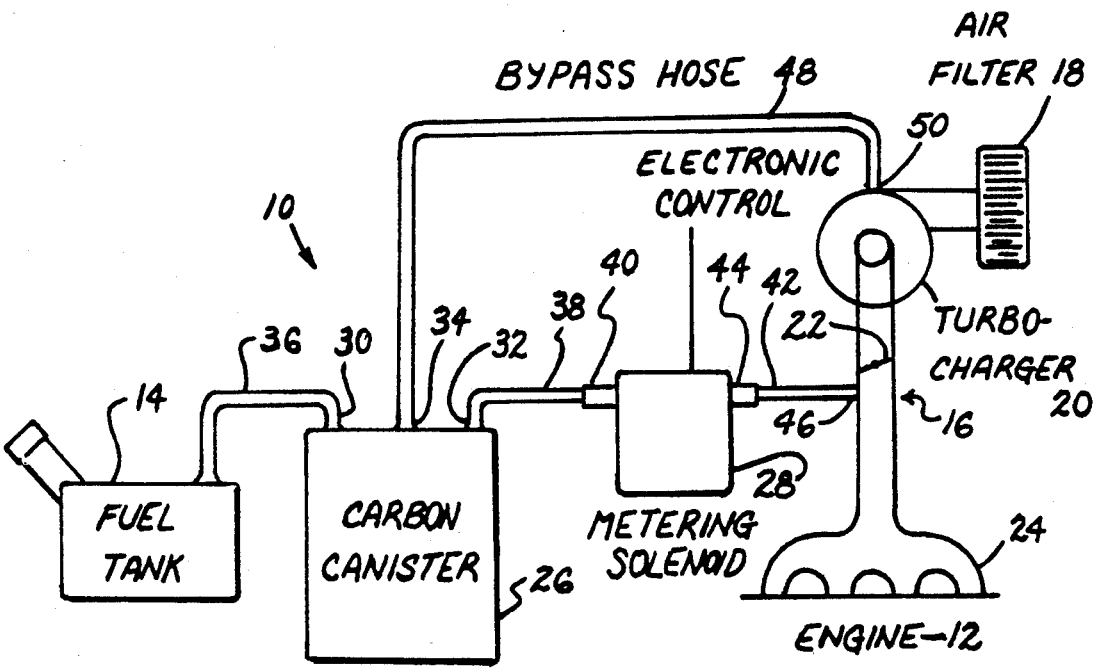
FIG. 1 is a schematic diagram of an evaporative emission control system in accordance with principles of the invention.

FIG. 1 shows an evaporative emission control system 10 in association an internal combustion engine 12 and a fuel tank 14 of an automotive vehicle. Engine 12 has an air intake system 16 comprising in order in the downstream direction an air filter 18, a supercharger 20, a throttle 22, and an intake manifold 24. Evaporative emission control system 10 comprises a vapor collection canister 26 and a canister purge valve 28. Canister 26 comprises an inlet port 30, an outlet port 32, and an atmospheric, or vent, port 34. A conduit 36 communicates inlet port 30 to headspace of tank 14, a conduit 38 communicates outlet port 32 to an inlet port 40 of canister purge valve 28, and a conduit 42 communicates an outlet port 44 of canister purge valve 28 to a port 46 of intake system 16 that is located downstream of throttle 22.

Principles of the invention involve communicating canister port 34 through a conduit 48 to a port 50 of intake system 16 that is located between air filter 18 and supercharger 20.

When the engine is operating without supercharging, system 10 operates essentially exactly as in the case of a strictly naturally aspirated engine. Although port 34 is communicated to the intake system by conduit 48, port 34 is nevertheless communicated to pressure that is substantially atmospheric because any pressure drop across air filter 18 is relatively insignificant. The purge flow is conducted from canister 26 through valve 28 and introduced to the induction flow at port 46, valve 28 being under the control of an engine management computer to set the size of restriction that is to be presented to the purge flow for controlling the amount of purge flow.

When the engine is operating with supercharging, the pressure at port 46 is superatmospheric, while the pressure at port 50 is much less than that at port 46. Accordingly, the higher pressure delivered through valve 28 to outlet port 32 of canister 26 will be effective to induce a purge flow from canister port 34 through conduit 48 to port 50 where the purged vapors entrain with the flow through intake system 16. During supercharged operation of the engine, purge valve 28 maintains control over the purge flow.

An example of the general type of canister suitable for a system that embodies the present invention is shown in U.S. Pat. No. 4,326,489. Such a canister adapted for connection to the system of the present invention will inherently accommodate the reversal of purge flow direction that occurs when the system switches between supercharged and non-supercharged modes of operation.

In view of the foregoing description, the reader should appreciate that the system of the invention is intended for use in engines which do not create the air-fuel charge that is to be combusted in the engine combustion chamber space upstream of port 46, meaning that it is intended for use in engines wherein the fuel is injected downstream of port 46, such as multi-point fuel injected engines having individual fuel injectors at the intake manifold injecting fuel directly at the intake valves.

What is claimed is:

1. An on-board evaporative emission control system of an automotive vehicle having a tank for storing volatile fuel which is used to power the vehicle, an internal combustion engine having combustion chamber space within which fuel supplied from said tank is combusted with air that has passed from atmosphere into the combustion chamber space through an air intake system which comprises a supercharger and a throttle arranged such that said supercharger is disposed upstream of said throttle, said supercharger being selectively operable to at some times create superatmospheric pressure in that portion of the intake system downstream of the supercharger while at other times allowing the operation of the engine to create subatmospheric pressure in that portion of the intake system downstream of the supercharger, said evaporative emission control system comprising a vapor collection canister having an inlet port, an outlet port, and a vent port and being constructed and arranged to allow flow in either direction between said vent port and said outlet port, means communicating said inlet port to headspace of said tank so that fuel vapors can enter and be collected in the canister, and means including purge control valve means communicating said outlet port with said intake system at a location which is downstream of said throttle, characterized by means communicating said vent port to said intake system at a location which is upstream of said supercharger such that when the pressure in the intake system downstream of the supercharger is subatmospheric, the canister purge flow is from the canister outlet port to the intake system and is controlled by said purge control valve, and when the pressure in the intake system downstream of the supercharger is superatmospheric, the canister purge flow is from the canister vent port to the intake system and is controlled by said purge control valve.

2. An on-board evaporative emission control system as set forth in claim 1 characterized further in that said intake system includes air filter means upstream of said supercharger for filtering certain particulate material from the air passing through said intake system before that air reaches said supercharger, and said means communicating said vent port to said intake system at a location which is upstream of said supercharger communicates with said intake system at a location which is between said air filter means and said supercharger.

* * * * *